US011339787B2

(12) United States Patent
Monasry et al.

(10) Patent No.: US 11,339,787 B2
(45) Date of Patent: May 24, 2022

(54) ROTARY COMPRESSOR AND REFRIGERATION CYCLE APPARATUS

(71) Applicant: TOSHIBA CARRIER CORPORATION, Kanagawa (JP)

(72) Inventors: Jafet Ferdhy Monasry, Shizuoka (JP); Takuya Hirayama, Shizuoka (JP); Hideaki Suzuki, Shizuoka (JP); Koji Hirano, Shizuoka (JP); Masaya Ichihara, Shizuoka (JP)

(73) Assignee: TOSHIBA CARRIER CORPORATION, Kanagawa (JP)

( * ) Notice: Subject to any disclaimer, the term of this patent is extended or adjusted under 35 U.S.C. 154(b) by 23 days.

(21) Appl. No.: 16/899,074

(22) PCT Filed: Jan. 25, 2018

(86) PCT No.: PCT/JP2018/002209
§ 371 (c)(1),
(2) Date: Jun. 11, 2020

(87) PCT Pub. No.: WO2019/146028
PCT Pub. Date: Aug. 1, 2019

(65) Prior Publication Data

US 2020/0408214 A1 Dec. 31, 2020

(51) Int. Cl.
*F04C 29/02* (2006.01)
*F04C 18/02* (2006.01)

(52) U.S. Cl.
CPC ..... *F04C 29/028* (2013.01); *F04C 18/0215* (2013.01); *F04C 2210/26* (2013.01);
(Continued)

(58) Field of Classification Search
CPC .. F04C 29/021; F04C 29/028; F04C 18/0215; F04C 18/0261; F04C 18/356; F04C 18/332; F04C 23/008
See application file for complete search history.

(56) References Cited

U.S. PATENT DOCUMENTS 6,322,339 B1 * 11/2001 Mitsunaga ..... F04C 18/0215 418/55.2
6,589,035 B1 * 7/2003 Tsubono ..... F04C 18/0215 418/55.5

(Continued)

FOREIGN PATENT DOCUMENTS

JP H01-071190 5/1989
JP H01-088092 6/1989

(Continued)

OTHER PUBLICATIONS

International Preliminary Report on Patentability in Application No. PCT/JP2018/002209 dated Jul. 28, 2020.

(Continued)

*Primary Examiner* — Deming Wan
(74) *Attorney, Agent, or Firm* — DLA Piper LLP US

(57) ABSTRACT

A highly reliable horizontal rotary compressor is provided with a sealed housing, an electric motor, a compression mechanism, a frame which divides the inside of the sealed housing into an electric-motor chamber and a compression-mechanism chamber, and a plurality of bolts that fasten the compression mechanism to the frame. The compression mechanism includes a main bearing fasten to the end surface of a cylinder. A bearing contact-surface of the end surface of the cylinder is in contact with the main bearing, is located closer to the electric motor than a frame contact-surface which is in contact with the frame. The surface roughness of the frame contact-surface is greater than the surface roughness of the bearing contact-surface. The contact-surface of the frame is a single continuous flat surface located above the bolt located at the lowest position among the plurality of bolts.

17 Claims, 8 Drawing Sheets

(52) U.S. Cl.
CPC ..... *F04C 2240/30* (2013.01); *F04C 2240/40* (2013.01); *F04C 2240/60* (2013.01)

(56) References Cited

U.S. PATENT DOCUMENTS

| | | | | |
|---|---|---|---|---|
| 2004/0107847 | A1* | 6/2004 | Makino | F04C 18/0215 100/37 |
| 2012/0237374 | A1* | 9/2012 | Ochiai | F04C 18/0215 417/410.5 |

FOREIGN PATENT DOCUMENTS

| | | |
|---|---|---|
| JP | H01-144495 | 10/1989 |
| JP | H02-157485 | 6/1990 |
| JP | H05-079485 | 3/1993 |
| JP | 2005-016478 | 6/2003 |
| JP | 2007-092643 | 4/2007 |

OTHER PUBLICATIONS

International Search Report in Application No. PCT/JP2018/002209 dated Apr. 17, 2018.
Written Opinion in Application No. PCT/JP2018/002209 dated Apr. 17, 2018.

* cited by examiner

ROTARY COMPRESSOR AND REFRIGERATION CYCLE APPARATUS

CROSS REFERENCE TO RELATED APPLICATIONS

This application claims the benefit of priority of No. PCT/JP2018/002209, filed on Jan. 25, 2018, the entire contents of each of which are incorporated herein by reference.

TECHNICAL FIELD

Embodiments of the present invention relates to a rotary compressor and a refrigeration cycle apparatus.

BACKGROUND

A horizontal rotary compressor is known. The horizontal rotary compressor includes: a horizontal sealed container; a rotating shaft extending in the longitudinal direction of the horizontal sealed container; and an electric motor and a compression mechanism that are connected each other using the rotating shaft.

A conventional horizontal rotary compressor includes a partition plate in the sealed container. The partition plate divides the inside of the sealed container into a first space in which the compression mechanism is accommodated and a second space in which the electric motor is accommodated. Lubricating oil is stored inside the sealed container. From the viewpoints of preventing energy loss of the electric motor due to the lubricating oil and reliably lubricating the compression mechanism with the lubricating oil, the oil level of the lubricating oil in the first space is higher than the oil level of the lubricating oil in the second space. The difference in oil level between the two spaces is caused by the differential pressure (i.e., pressure difference) between the first space and the second space.

PRIOR ART DOCUMENT

Patent Document

[Patent Document 1] JP 2005-016478 A

SUMMARY

Problems to be Solved by Invention

Another known rotary compressor includes: an annular frame fixed to the inner wall surface of the sealed container; and a cylinder fixed to this frame (for example, JP H09-158883 A). That is, the compression mechanism is supported in the sealed container via the frame fixed to the cylinder.

Such a support structure (support style) of the compression mechanism is applied to a horizontal rotary compressor in some cases. In this case, in order to accurately control the height of an oil level of a lubricating oil in a first space for accommodating the compression mechanism and an oil level of the lubricating oil in a second space for accommodating the electric motor, it is required to suppress a leakage of the high-pressure refrigerant at the contact surface between the frame and the cylinder.

Accordingly, the present invention provides: a highly reliable horizontal rotary compressor that can support the compression mechanism in the container via the frame, and is capable of reliably lubricating the compressor while preventing energy loss of the electric motor; and a refrigeration cycle apparatus including such the highly reliable horizontal rotary compressor.

Means for Solving Problem

To achieve the above object, an aspect of the present invention provides a rotary compressor including: a horizontal housing that stores lubricating oil; an electric motor that is housed in the housing; a compression mechanism that is housed in the housing; a rotating shaft that extends in a longitudinal direction of the housing and connects the electric motor to the compression mechanism; a frame that supports the compression mechanism in the housing, divides inside of the housing into an electric-motor chamber for housing the electric motor and a compression-mechanism chamber for housing the compression mechanism, and includes at least one compressed-refrigerant passage for leading compressed refrigerant from the electric-motor chamber to the compression-mechanism chamber and a lubricating-oil passage for flowing lubricating oil between the electric-motor chamber and the compression-mechanism chamber; and a plurality of fixing members that fix the compression mechanism to the frame. The compression mechanism includes a cylinder provided with a cylinder chamber, and a main bearing that is fixed to a face of the cylinder on a side closer to the electric motor to seal the cylinder chamber and rotatably supports the rotating shaft. A face of the cylinder on a side close to the electric motor is fixed to a cylinder contact-surface of the frame. The face of the cylinder on the side close to the electric motor includes a bearing contact-surface in contact with the main bearing, and a frame contact-surface that is disposed radially outside of the cylinder than the bearing contact-surface to contact the frame. The bearing contact-surface is closer to the electric motor than the frame contact-surface. Surface roughness of the frame contact-surface is rougher than surface roughness of the bearing contact-surface. The cylinder contact-surface in contact with the frame contact-surface is a continuous flat plane above a fixing member disposed at a lowermost position among the plurality of fixing members.

It may be further desired that a suction passage that penetrates the housing and the cylinder, is connected to the cylinder chamber, and leads working fluid from outside of the housing to the cylinder chamber. A gap is formed between the frame and the cylinder near the suction passage.

It may be desired that the cylinder contact-surface of the frame is a convex portion protruding in a C-shape.

It may be desired that the gap is filled with the lubricating oil in the housing.

It may be desired that the working fluid is carbon dioxide. When sum of cross-sectional areas of the at least one compressed-refrigerant passage is defined as a first area, and sum of passage cross-sectional areas of the suction passage is defined as a second area, relationship between the first area and the second area satisfies $0.5<\text{first area}/\text{second area}<0.85$.

It may be further desired that a discharge passage that is provided to penetrate the housing and, discharges the compressed refrigerant from inside of the housing. An angle formed by the compressed-refrigerant passage and the discharge passage with reference to a centerline of the housing is 10 degrees or more. The compressed-refrigerant passage is inclined toward an oil surface direction of the lubricating oil in the compression-mechanism chamber.

It may be further desired that a differential pressure regulating valve that is provided in at least one compressed refrigerant passage, and is opened when a differential pressure between the electric-motor chamber and the compression-mechanism chamber reaches a predetermined differential pressure.

Further, to achieve the above object, an aspect of the present invention provides a refrigeration cycle apparatus including: the rotary compressor; a radiator; an expansion device; a heat absorber; and a refrigerant pipe that connects the rotary compressor, the radiator, the expansion device, and the heat absorber to circulate a refrigerant.

DETAILED DESCRIPTION

Embodiments of a rotary compressor and a refrigeration cycle apparatus according to the present invention will now be described by referring to FIG. 1 to FIG. 7. The same reference signs are given to identical or equivalent components in each figure.

Figure 1:
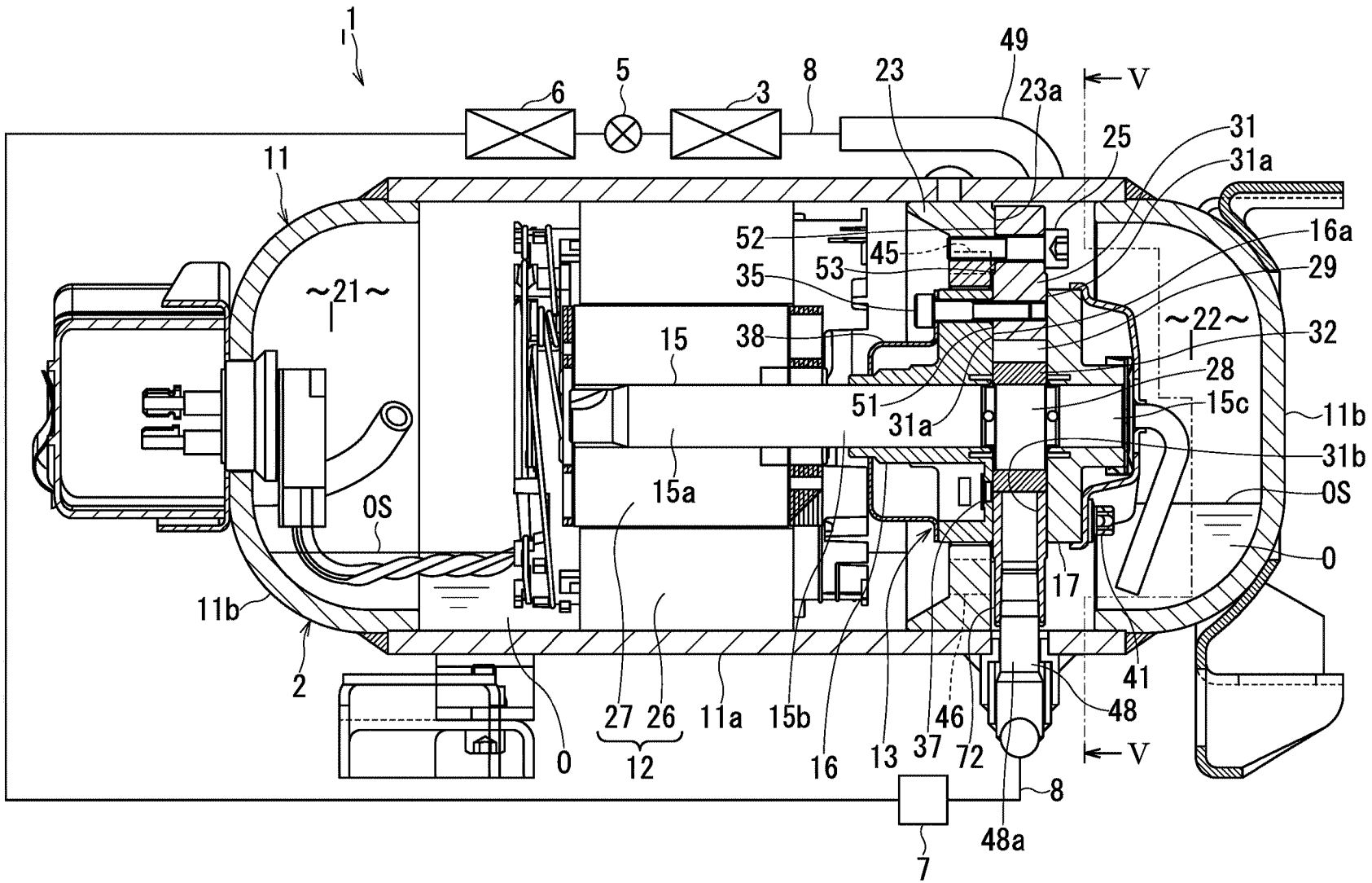
FIG. 1 is a schematic diagram of a refrigeration cycle apparatus including a longitudinal cross-sectional view of a rotary compressor according to one embodiment of the present invention.

FIG. 1 is a schematic diagram of the refrigeration cycle apparatus including a longitudinal cross-sectional view of the rotary compressor according to one embodiment of the present invention.

Figure 2:
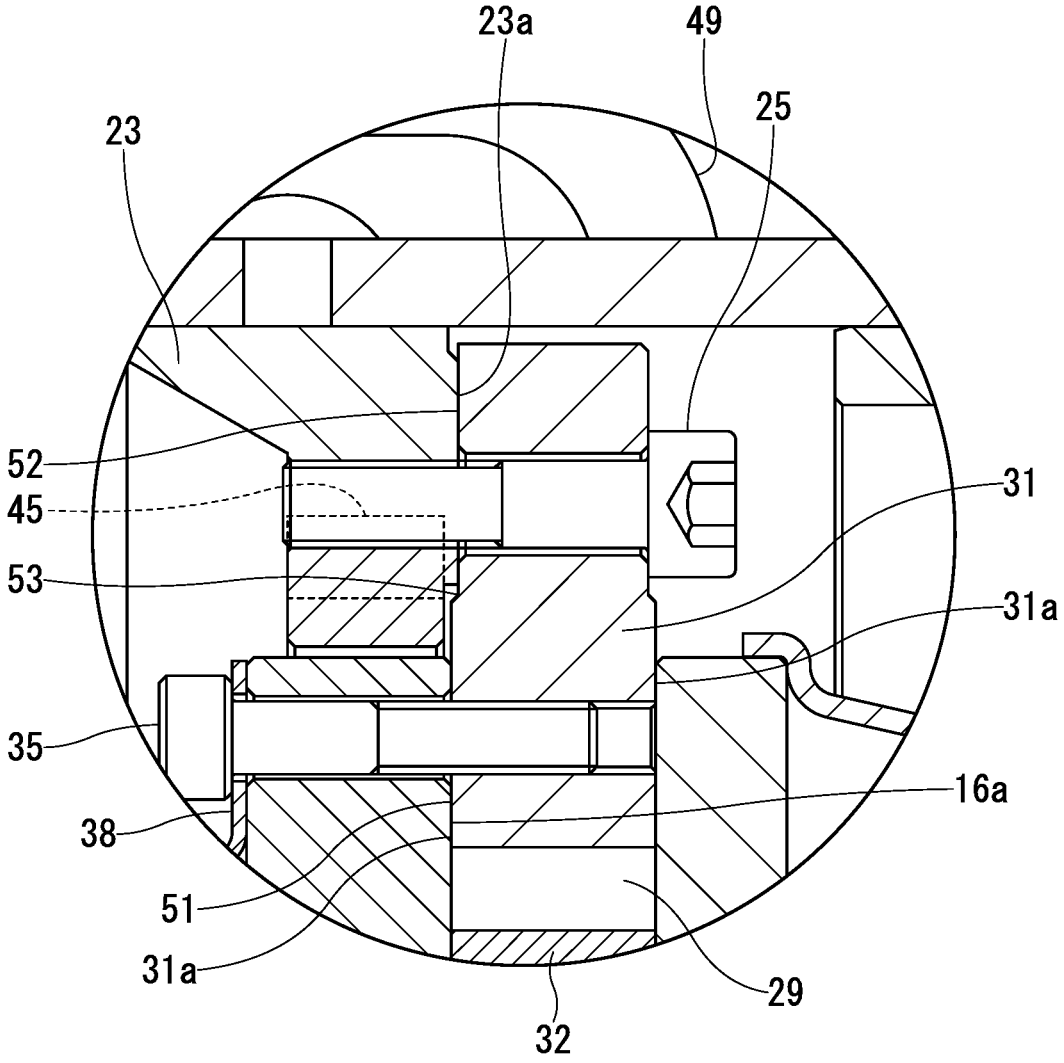
FIG. 2 is a partial enlarged view of the longitudinal sectional view of the rotary compressor according to the embodiment of the present invention.

FIG. 2 is a partial enlarged view of the longitudinal sectional view of the rotary compressor according to the embodiment of the present invention.

As shown in FIG. 1 and FIG. 2, the refrigeration cycle apparatus 1 according to the present embodiment includes: a horizontal rotary compressor 2; a radiator 3 (condenser 3); an expansion device 5; a heat absorber 6 (evaporator 6); and a refrigerant pipe 8. The refrigerant pipe 8 sequentially connects the rotary compressor 2, the condenser 3, the expansion device 5, and the evaporator 6 so as to circulate the refrigerant.

The rotary compressor 2 according to the present embodiment is installed in the state where its sealed housing 11 as a horizontally long container is laid down. The rotary compressor 2 includes: the sealed housing 11 that is in a horizontally long shape and can store lubricating oil O; an electric motor 12 housed in the sealed housing 11; a compression mechanism 13 housed in the sealed housing 11 together with the electric motor 12; a rotating shaft 15 that connects the electric motor 12 and compression mechanism 13 to each other; a main bearing 16 that rotatably supports the rotating shaft 15; an auxiliary bearing 17 that rotatably supports the rotating shaft 15 in cooperation with the main bearing 16; and an accumulator 7 provided with the side of the sealed housing 11.

The rotary compressor 2 further includes; a frame 23 that supports the compression mechanism 13 in the sealed housing 11 and divides the inside of the sealed housing 11 into an electric-motor chamber 21 for housing the electric motor 12 and a compression-mechanism chamber 22 for housing the compression mechanism 13; and bolts 25 as a plurality of fixing members that fix the compression mechanism 13 to the frame 23.

The sealed housing 11 has a cylindrical and horizontally long shape. The longitudinal direction of the sealed housing 11, i.e., the direction along the centerline of the cylinder is laid down with respect to the ground-contact surface. The sealed housing 11 includes: a body portion 11*a*, both ends of which are open; and a pair of end plates 11*b* for closing the respective ends of the body portion 11*a*. The lubricating oil O is stored in the sealed housing 11.

The electric motor 12 generates rotational driving force of the compression mechanism 13. The electric motor 12 includes: a stator 26 fixed to the inner-wall of the sealed housing 11; and a rotor 27 fixed to one end 15*a* of the rotating shaft 15 and surrounded by the stator 26.

The rotating shaft 15 connects the electric motor 12 and the compression mechanism 13 to each other. The rotating shaft 15 transmits the rotational driving force to be generated using the electric motor 12 to the compression mechanism 13. The rotating shaft 15 extends in the longitudinal direction of the sealed housing 11. The rotating shaft 15 is disposed on the centerline of the sealed housing 11.

The intermediate portion 15*b* of the rotating shaft 15 is rotatably supported by the main bearing 16. The other end 15*c* of the rotating shaft 15 is rotatably supported by the auxiliary bearing 17. The rotating shaft 15 penetrates the compression mechanism 13.

The rotating shaft 15 has an eccentric portion 28. The eccentric portion 28 is a disk or a cylinder having a center that does not match the center of the rotating shaft 15.

When the electric motor 12 rotationally drives the rotating shaft 15, the compression mechanism 13 draws in working fluid (i.e., gaseous refrigerant) and compresses it, and then discharges it to the electric-motor chamber 21.

The compression mechanism 13 includes: a cylinder 31 provided with a cylinder chamber 29; and the main bearing 16 and the auxiliary bearing 17 as a pair of closure plates that are respectively provided on one end face and the other end face of the cylinder 31 so as to close the cylinder chamber 29; and a roller 32 disposed inside the cylinder 31.

The cylinder 31 has a circular cylinder chamber 29. The center of the cylinder chamber 29 substantially matches the rotation center of the rotating shaft 15. The cylinder chamber 29 is a space inside the cylinder 31 and is closed by the main bearing 16 and the auxiliary bearing 17. The eccentric portion 28 of the rotating shaft 15 is disposed in the cylinder chamber 29.

The main bearing 16 covers the end face 31*a* of the cylinder 31 on the side closer to the electric motor 12. The main bearing 16 is fixed to the cylinder 31 with a bolt 35 as a second fixing member. The main bearing 16 is provided with: a discharge-valve mechanism 37 that discharges the refrigerant compressed inside the cylinder chamber 29; and a discharge muffler 38. The discharge muffler 38 covers the discharge-valve mechanism 37. The discharge muffler 38 has a discharge outlet (not shown). The space inside the discharge muffler 38 communicates with the electric-motor chamber 21 via the discharge outlet. The discharge-valve mechanism 37 is connected to the cylinder chamber 29. When the differential pressure between the cylinder chamber 29 and the inside of the discharge muffler 38 (i.e., differential pressure between the cylinder chamber 29 and the electric-motor chamber 21) reaches a predetermined differential pressure value due to the compression action of the compression mechanism 13, the discharge-valve mechanism 37 releases and discharges the compressed refrigerant into the discharge muffler 38.

The auxiliary bearing 17 closes the end face 31*b* of the cylinder 31 on the side far from the electric motor 12. The auxiliary bearing 17 is fixed to the cylinder 31 with a bolt 41 as a third fixing member.

The roller 32 is interdigitated with the eccentric portion 28 of the rotating shaft 15 and is accommodated in the cylinder chamber 29. The roller 32 eccentrically moves with the rotation of the rotating shaft 15 while bringing a part of the outer peripheral surface of the roller 32 into contact with the inner peripheral surface of the cylinder chamber 29. Although the contact between the roller 32 and the cylinder 31 is not a direct contact but an indirect contact via an oil film (not shown) interposed therebetween, the contact via the oil film is herewith referred to as "contact" in brief to avoiding complications. The same applies between the roller 32 and the eccentric portion 28, between the roller 32 and the main bearing 16, and between the roller 32 and the auxiliary bearing 17.

The frame 23 is fixed to the sealed housing 11 by welding. The frame 23 is made of a casting or a sintered material. The frame 23 includes: at least one compressed-refrigerant passage 45 for leading the compressed refrigerant from the electric-motor chamber 21 to the compression-mechanism chamber 22; and a lubricating-oil passage 46 for moving the lubricating oil O between the electric-motor chamber 21 and the compression-mechanism chamber 22. The end face 31*a* of the cylinder 31 on the side closer to the electric motor 12 is fixed to the frame 23.

The lubricating-oil passage 46 is disposed below the lowermost end of the rotor 27 of the electric motor 12. When the oil level OS of the lubricating oil O in the electric-motor chamber 21 falls below the lower end of the outer peripheral surface of the rotor 27, the lubricating oil O does not hinder the rotation of the rotor 27.

The rotary compressor 2 further includes: a suction passage 48 that penetrates the sealed housing 11 and the cylinder 31 and is connected to the cylinder chamber 29 so as to lead the working fluid from the outside of the sealed housing 11 to the cylinder chamber 29; and a discharge passage 49 that is provided to penetrate the housing 11, and discharges the compressed refrigerant from the inside of the sealed housing 11. The suction passage 48 and the discharge passage 49 are spatially connected with the refrigerant pipe 8.

The suction passage 48 extends upward from below the sealed housing 11 and reaches the cylinder 31 from the outside of the sealed housing 11.

The discharge passage 49 communicates with the compression-mechanism chamber 22 of the sealed housing 11.

The rotary compressor 2 drives the electric motor 12 and operates the compression mechanism 13. The compression mechanism 13 causes the roller 32 to eccentrically move in the cylinder chamber 29, thereby sucks the refrigerant as the working fluid from the suction passage 48 into the cylinder chamber 29, and compresses the refrigerant sucked into the cylinder chamber 29. Thereafter, the compression mechanism 13 discharges the compressed refrigerant to the electric-motor chamber 21. The rotary compressor 2 causes the compressed refrigerant having been discharged to the electric-motor chamber 21 to flow out to the compression-mechanism chamber 22 through the compressed-refrigerant passage 45 of the frame 23, and then discharges the compressed refrigerant having flowed into the compression-mechanism chamber 22 from the discharge passage 49 to the outside of the sealed housing 11.

Further, the rotary compressor 2 causes difference in liquid level (i.e., height of the oil level OS) of the lubricating oil O between the electric-motor chamber 21 and the compression-mechanism chamber 22 by the differential pressure between both chambers.

Figure 3:
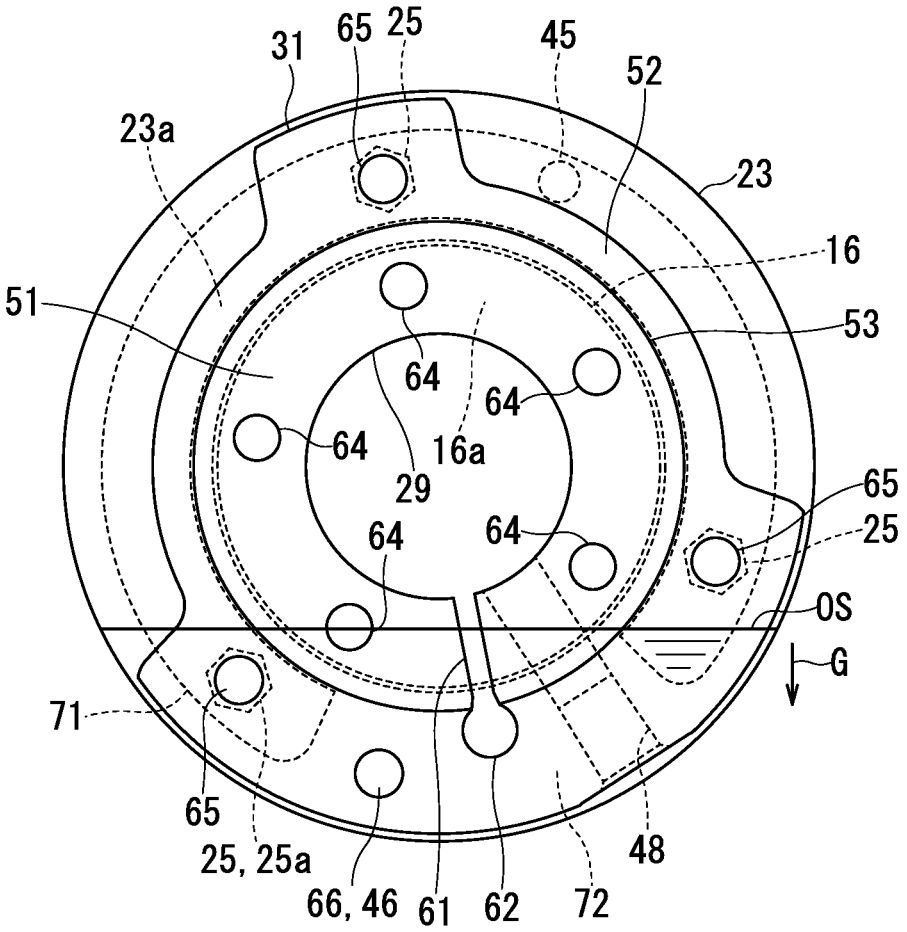
FIG. 3 is a diagram illustrating relationship between a cylinder, a main bearing, and a contact surface of a frame of the rotary compressor according to the embodiment of the present invention.

FIG. 3 is a diagram illustrating relationship between the cylinder, the main bearing, and the contact surface of the frame of the rotary compressor according to the embodiment of the present invention.

Figure 4:
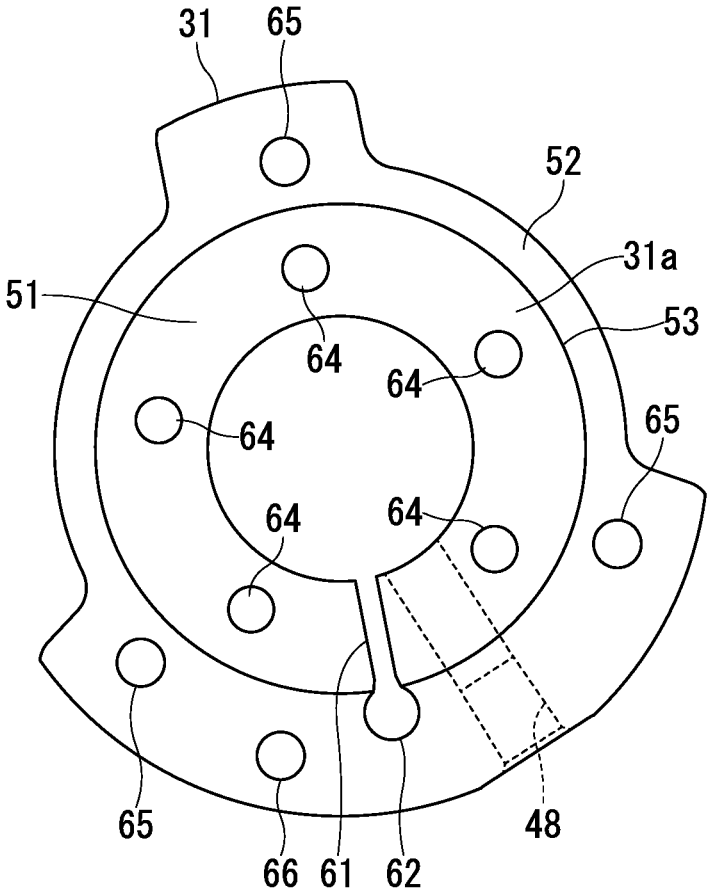
FIG. 4 is a diagram illustrating the contact surface of the cylinder of the rotary compressor according to the embodiment of the present invention.

FIG. 4 is a diagram illustrating the contact surface of the cylinder of the rotary compressor according to the embodiment of the present invention.

Figure 5:
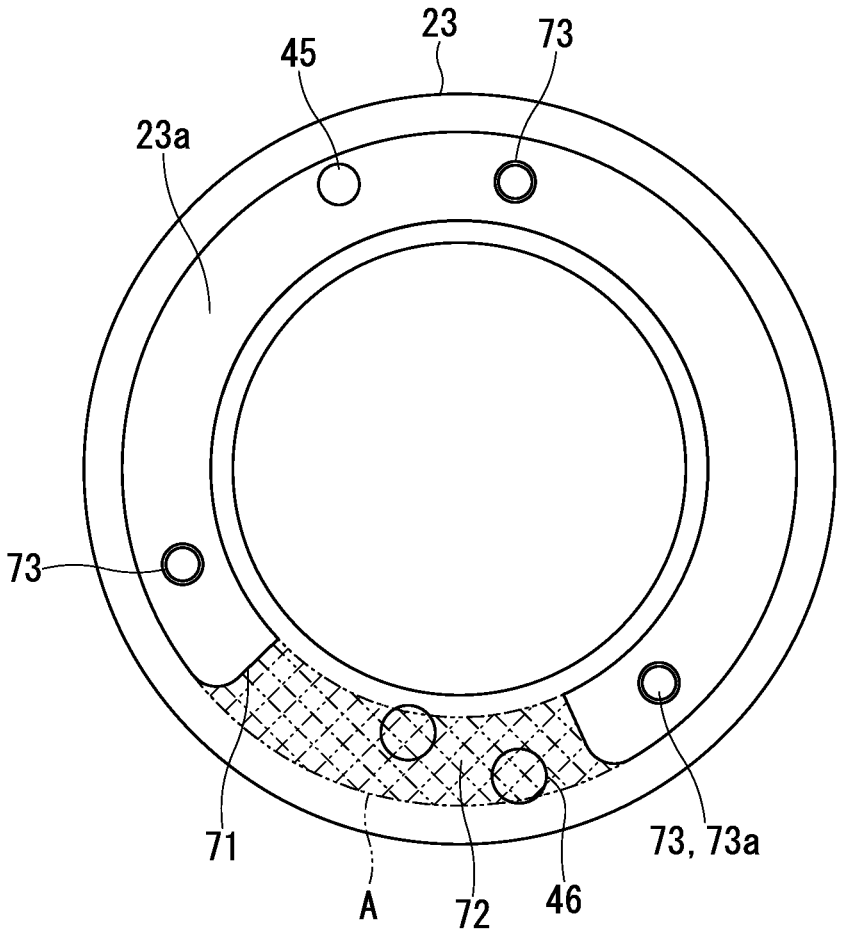
FIG. 5 is a diagram illustrating the contact surface of the frame of the rotary compressor according to the embodiment of the present invention.

FIG. 5 is a diagram illustrating the contact surface of the frame of the rotary compressor according to the embodiment of the present invention.

Note that the solid arrow G in FIG. 3 indicates a vertically downward direction in the installed state of the rotary compressor 2.

As shown in FIG. 3 and FIG. 4 in addition to FIG. 1, the cylinder 31 of the rotary compressor 2 according to the present embodiment has the end face 31*a* on the side closer to the electric motor 12

The end face 31*a* of the cylinder 31 on the side closer to the electric motor 12 includes: a bearing contact-surface 51 in contact with the main bearing 16; and a frame contact-surface 52 that is disposed radially outside of the cylinder 31 than the bearing contact-surface 51 so as to contact the frame 23.

The end surface 31*a* of the cylinder 31 has a step portion 53 at the boundary between the bearing contact-surface 51 and the frame contact-surface 52. The bearing contact-surface 51 occupies the inner side (i.e., the side closer to the cylinder chamber 29) than the step portion 53. The frame contact-surface 52 occupies the outer side (i.e., the side farther from the cylinder chamber 29) than the step portion 53. The bearing contact-surface 51 and the frame contact-surface 52 are adjacent to each other with the step portion 53 interposed as a boundary therebetween. The bearing contact-surface 51 protrudes more in the thickness direction of the cylinder 31 than the frame contact-surface 52. In other words, the bearing contact-surface 51 is closer to the electric motor 12 than the frame contact-surface 52.

When viewed from the direction along the centerline of the cylinder chamber 29, the cylinder 31 has a circular shape in which the outer periphery is partially cut away. The cylinder 31 includes: a vane groove 61 opened into the cylinder chamber 29; and a vane back chamber 62 connected to the end of the vane groove 61 on the side farther from the cylinder chamber 29. The vane groove 61 is a groove extending in the radial direction of the cylinder 31. A vane (not shown) provides in the vane groove 61. In the state of protruding into the cylinder chamber 29, the vane makes a line contact with the outer peripheral surface of the circular roller 32 via the oil film regardless of the rotation angle of the roller 32. The vane back chamber 62 is open in the sealed housing 11.

The bearing contact-surface 51 is an annular plane except the portion divided by the vane groove 61. Screw holes 64 are formed in the bearing contact-surface 51. A bolt 35 for fixing the main bearing 16 to the cylinder 31 is tightened in each screw hole 64. The number of the screw holes 64 is the same as the number of the bolts 35, and the screw holes 64 are evenly arranged in the circumferential direction of the cylinder 31. The bearing contact-surface 51 protrudes in the thickness direction of the cylinder 31 more than frame contact-surface 52, and thus, polishing can be readily performed without being disturbed by the frame contact-surface 52, for example. In other words, the bearing contact-surface 51 can be readily processed into a smoother surface as compared with the frame contact-surface 52.

The step portion 53 is connected to the outer periphery of the bearing contact-surface 51 and the inner periphery of the frame contact-surface 52.

The frame contact-surface 52 surrounds the periphery of the bearing contact-surface 51 in an annular shape. The shape of the outer edge of the frame contact-surface 52 follows the shape of the outer edge of the cylinder 31. Through holes 65 are formed in the frame contact-surface 52. Bolts 25 for fixing the cylinder 31 to the frame 23 are inserted through respective through holes 65. The number of the through holes 65 is the same as the number of the bolts 25, and the through holes 65 are evenly arranged in the circumferential direction of the cylinder 31. In the frame contact-surface 52, a lubricating oil passage 66 is formed for allowing the lubricating oil O to flow between the electric-motor chamber 21 and the compression-mechanism chamber 22, similarly to the frame 23.

The surface roughness of the frame contact-surface 52 is rougher than the surface roughness of the bearing contact-surface 51. The frame 23 has the cylinder contact-surface 23*a* in contact with the frame contact-surface 52 of the cylinder 31, and the main bearing 16 has the contact surface 16*a* in contact with the bearing contact-surface 51 of the cylinder 31. It is sufficient that the cylinder contact-surface 23*a* of the frame 23 has almost the same surface roughness as the frame contact-surface 52 of the cylinder 31. Additionally, it is sufficient that the contact surface 16*a* of the main bearing 16 has almost the same surface roughness as the bearing contact-surface 51 of the cylinder 31. That is, the surface roughness of the contact-surface 23*a* of the frame 23 may be rougher than the surface roughness of the contact surface 16*a* of the main bearing 16.

The gap between the bearing contact-surface 51 of cylinder 31 and the contact surface 16*a* of the main bearing 16 is related to the leakage of the working fluid to be compressed in the cylinder chamber 29, and the gap between the frame contact-surface 52 of the cylinder 31 and the cylinder contact-surface 23*a* of the frame 23 is related to the leakage between the electric-motor chamber 21 and the compression-mechanism chamber 22. The surface roughness of each of the bearing contact-surface 51 of the cylinder 31 and the contact surface 16*a* of the main bearing 16 is smoother than the surface roughness of each of the frame contact-surface 52 of the cylinder 31 and the contact-surface 23*a* of the frame 23, and the gap between the cylinder 31 and the main bearing 16 is less likely to leak the refrigerant than the gap between the cylinder 31 and the frame 23.

As shown in FIG. 3 and FIG. 5 in addition to FIG. 1, the frame 23 of the rotary compressor 2 according to the present embodiment has a ring shape. The frame 23 includes a convex portion 71 that is the cylinder contact-surface 23*a* being in contact with the frame contact-surface 52 of the cylinder 31. The convex portion 71 protrudes in a C-shape interrupted by the gap 72. The convex portion 71 and the contact-surface 23*a* forms a concentric arc shape on the frame 23.

Screw holes 73 are formed in the contact-surface 23*a*. The bolts 25 for fixing the cylinder 31 to the frame 23 are screwed into the screw holes 73. The number of the screw holes 73 is the same as the number of the bolts 25, and the screw holes 73 are evenly arranged in the circumferential direction of the frame 23. In the contact-surface 23*a*, the lubricating-oil passage 46 penetrates for allowing the lubricating oil O to flow between the electric-motor chamber 21 and the compression-mechanism chamber 22. The lubricating-oil passage 46 is substantially linearly aligned with the lubricating-oil passage 66 of the cylinder 31.

The contact-surface 23*a* is a continuous flat plane above the bolt 25*a* (or the screw hole 73*a*) disposed at the lowermost position among the plurality of bolts 25 (or the plurality of screw holes 73). In other words, in the region above the bolt 25*a* disposed at the lowermost position, the frame contact-surface 52 of the cylinder 31 and the cylinder contact-surface 23*a* of the frame 23 are in continuous contact with each other without being interrupted. The bolt 25*a* and the screw hole 73*a* are submerged in the lubricating oil O in the sealed housing 11.

In other words, in the region above the bolt 25*a* disposed at the lowermost position, the annular frame contact-surface 52 of the cylinder 31 and the C-shaped contact-surface 23*a* of the frame 23 are in continuous contact with each other without interruption in the rotary compressor 2 according to the present embodiment. Since this bolt 25*a* disposed at the lowermost position is submerged in the lubricating oil O in the sealed housing 11, the continuous contact portion between the frame contact-surface 52 of the cylinder 31 and the contact-surface 23*a* of the frame 23 submerges the C-shaped open end portion in the lubricating oil and reliably separates the space filled with the compressed refrigerant in the electric-motor chamber 21 from the space filled with the compressed refrigerant in the compression-mechanism chamber 22. The leakage of the compressed refrigerant at the contact surface between the cylinder 31 and the frame 23 (i.e., the frame contact-surface 52 and the cylinder contact-surface 23*a*) is extremely small and negligible as compared with the flow rate of the compressed refrigerant flowing out from the electric-motor chamber 21 to the compression-mechanism chamber 22 through the compressed-refrigerant passage 45 of the frame 23. Thus, the compressed refrigerant in the electric-motor chamber 21 reliably flows out through the compressed-refrigerant passage 45 to the compression-mechanism chamber 22. In other words, the rotary compressor 2 can accurately control the differential pressure between the electric-motor chamber 21 and the compression-mechanism chamber 22, and can reliably arrange the oil level OS of the lubricating oil O in the compression-mechanism chamber 22 at an appropriate position.

In the rotary compressor 2 according to the present embodiment, the continuous contact portion between the frame contact-surface 52 of the cylinder 31 and the cylinder contact-surface 23*a* of the frame 23 are fastened using the bolts 25. Thus, the rotary compressor 2 can reduce deformation of the cylinder 31 at the time of fixing the cylinder 31 to the frame 23 as much as possible. Further, the rotary compressor 2 can uniformly apply a larger frictional force to the contact surface (friction contact surface) between the cylinder 31 and the frame 23. This reliably prevents the displacement of the contact surface between the cylinder 31 and the frame 23 due to, for example, an external load to be applied in a transportation process.

Further, the surface roughness of the frame contact-surface 52 of the cylinder 31 and the cylinder contact-surface 23*a* of the frame 23 is rougher than the surface roughness of the bearing contact-surface 51 of the cylinder 31 and the contact surface 16*a* of the main bearing 16. Thus, the frame 23 is fixed more firmly than main bearing 16.

The portion of the cylinder contact-surface 23*a* provided with the compressed-refrigerant passage 45 is not in contact with the frame contact-surface 52 of the cylinder 31. In other words, the compressed-refrigerant passage 45 is never blocked by the cylinder 31.

Although the inner peripheral portion of the frame 23 is overlaid so as to cover the outer peripheral portion of the bearing contact-surface 51 of the cylinder 31, this overlaid portion is not in contact with the bearing contact-surface 51. That is, the protrusion amount (i.e., protrusion height dimension) of the convex portion 71 of the frame 23 is larger than the height dimension of the step portion 53 between the bearing contact-surface 51 and the frame contact-surface 52.

The gap 72 penetrating in the radial direction of the frame 23 is provided between the cylinder 31 and the frame 23 in the vicinity of the suction passage 48. The gap 72 corresponds to the portion (i.e., cross-hatched region A indicated by the two-dot chain line in FIG. 5) where the convex portion 71 protruding in a C-shape of the frame 23 is interrupted. The gap 72 is filled with the lubricating oil O in the sealed housing 11.

A suction pipe 48*a* forming the suction passage 48 spatially connected with the cylinder chamber 29 is press-fitted into a suction hole 31*b* of the cylinder 31 from the outside of the sealed housing 11. Accordingly, the gap 72 between the cylinder 31 and the frame 23 allows the deformation of the cylinder 31 when the suction passage 48 is press-fitted, and reduces the influence of the deformation of the cylinder 31 on the contact surface (i.e., the frame contact-surface 52 and the contact-surface 23*a*) between the cylinder 31 and the frame 23.

Since the gap 72 is submerged in the lubricating oil O, the vicinity of the suction passage 48 of the cylinder 31 is also submerged in the lubricating oil. Thus, heating near the suction passage 48 by the compressed refrigerant is prevented. Hence, heating of the working fluid (i.e., refrigerant) to be sucked into the cylinder chamber 29 from the suction passage 48 is reduced, and consequently, the performance of the rotary compressor 2 is enhanced.

Figure 6:
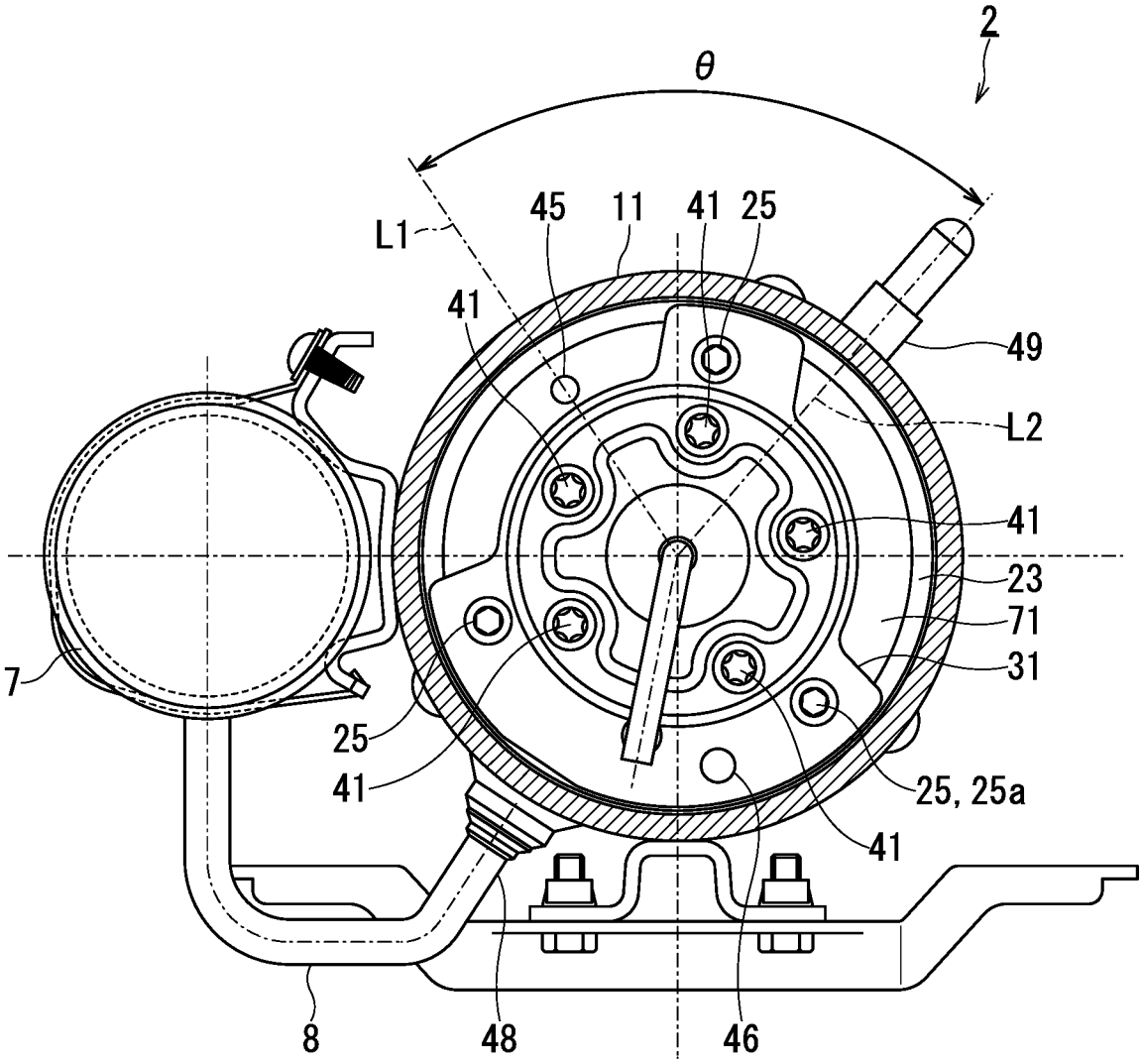
FIG. 6 is a diagram illustrating the rotary compressor according to the embodiment of the present invention.

FIG. 6 is a diagram illustrating the rotary compressor according to the embodiment of the present invention, taken along line V-V in FIG. 1.

As shown in FIG. 6, the rotary compressor 2 according to the present embodiment has an angle θ formed by the compressed-refrigerant passage 45 and the discharge passage 49 with reference to the centerline of the sealed housing 11. On the basis of this centerline of the sealed housing 11, the angle θ formed by the compressed-refrigerant passage 45 and the discharge passage 49 is 10 degrees or more.

That is, when the line segment connecting the centerline of the sealed housing 11 to the centerline of the compressed-refrigerant passage 45 is defined as a line segment L1 and the line segment connecting the centerline of the sealed housing 11 to the centerline of the discharge passage 49 (i.e., center at the opening of the sealed housing 11) is defined as a line segment L2, the angle θ formed by the line segment L1 and the line segment L2 is the phase difference θ and is set to 10 degrees or more.

The angle θ formed by the compressed-refrigerant passage 45 and the discharge passage 49 prevents discharge of the lubricating oil O from the discharge passage 49 to the outside of the rotary compressor 2.

Next, other aspects of the frame 23 of the rotary compressor 2 according to the present embodiment will be described. In frames 23A and 23B described as other aspects, the same components as those in the frame 23 are denoted by the same reference signs and duplicate description is omitted.

Figure 7:
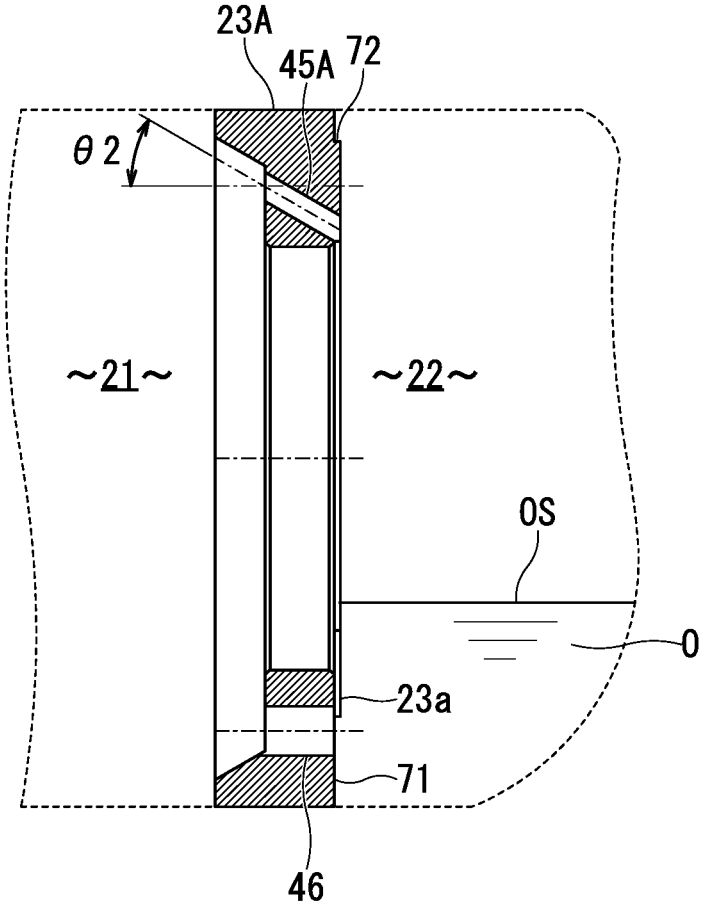
FIG. 7 is a longitudinal cross-sectional view of another aspect of the frame of the rotary compressor according to the embodiment of the present invention.

FIG. 7 is a longitudinal cross-sectional view of another aspect of the frame of the rotary compressor according to the embodiment of the present invention.

As shown in FIG. 7, the frame 23A of the rotary compressor 2 according to the present embodiment has an inclined compressed-refrigerant passage 45A. The compressed-refrigerant passage 45A is inclined toward the oil level OS of the lubricating oil O in the compression-mechanism chamber 22 (with the inclination angle θ2). In other words, the compressed-refrigerant passage 45A is inclined with respect to the rotation centerline of the rotating shaft 15, the centerline of the sealed housing 11, the centerline of the cylinder 31, and the centerline of the frame 23A. The compressed-refrigerant passage 45A is inclined from the electric-motor chamber 21 in the sealed housing 11 toward the compression-mechanism chamber 22 in the direction approaching the rotation centerline of the rotating shaft 15, the centerline of the sealed housing 11, the centerline of the cylinder 31, and the centerline of the frame 23A.

The tilted compressed-refrigerant passage 45A prevents discharge of the lubricating oil O from the discharge passage 49 to the outside of the rotary compressor 2. For example, the partition plate of the conventional rotary compressor has insufficient passage length of the compressed-refrigerant passage 45A. Thus, in the conventional partition plate, it is difficult to direct the compressed refrigerant toward the direction of the oil level OS of the lubricating oil O in the compression-mechanism chamber 22 as in the tilted compressed-refrigerant passage 45A.

Figure 8:
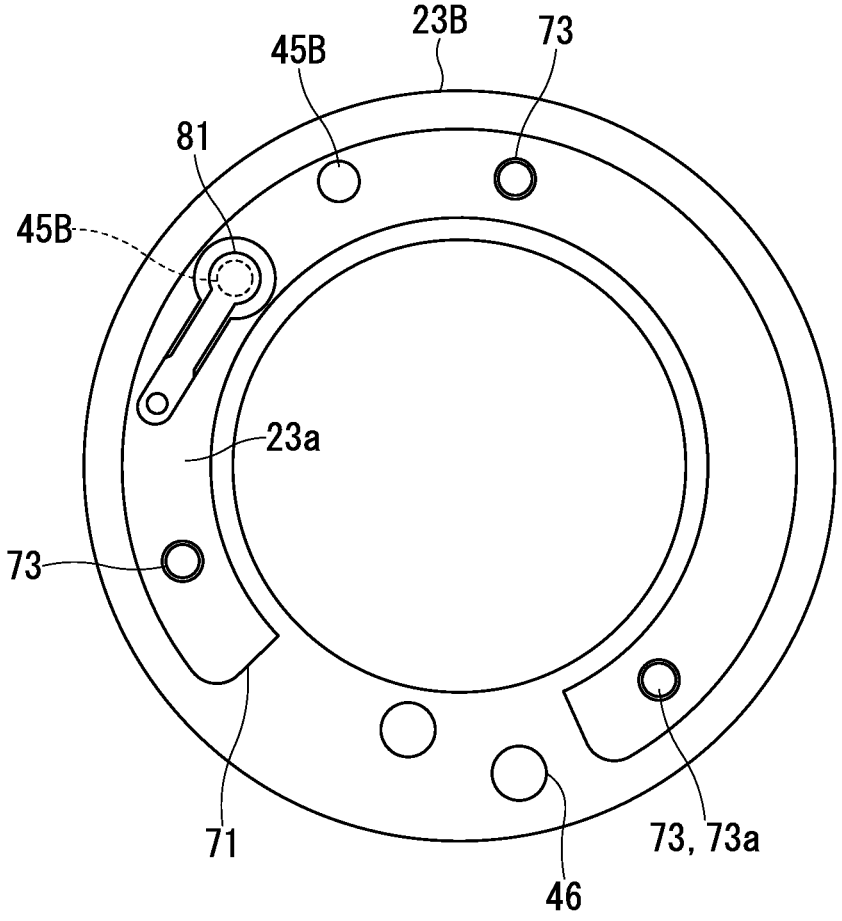
FIG. 8 is a front view of still another aspect of the frame of the rotary compressor according to the embodiment of the present invention.

FIG. 8 is a front view of still another aspect of the frame of the rotary compressor according to the embodiment of the present invention.

As shown in FIG. 8, the frame 23B of the rotary compressor 2 according to the present embodiment includes: a plurality of compressed-refrigerant passages 45B; and a differential pressure regulating valve 81 that is provided in at least one of the compressed-refrigerant passages 45B and is opened when the differential pressure between the electric-motor chamber 21 and the compression-mechanism chamber 22 reaches a predetermined differential pressure.

The differential pressure between the electric-motor chamber 21 and the compression-mechanism chamber 22 is proportional to the discharge flow rate of the compressed refrigerant of the rotary compressor 2. Thus, the differential pressure regulating valve 81 appropriately secures the differential pressure between the electric-motor chamber 21 and the compression-mechanism chamber 22 regardless of the discharge flow rate of the compressed refrigerant of the rotary compressor 2 so as to appropriately maintain the difference in liquid level between the oil level OS of the lubricating oil O in the electric-motor chamber 21 and the oil level OS of the lubricating oil O in the compression-mechanism chamber 22.

Considering a case where carbon dioxide is used for the refrigerant of the rotary compressor 2, when the sum of the cross-sectional areas of the compressed-refrigerant passages 45, 45A, or 45B is defined as the first area and the sum of the cross-sectional areas of the suction passage 48 is defined as the second area, it is preferred that the relationship between the first area and the second area satisfies the following expression.

$$0.5<(\text{first area}/\text{second area})<0.85$$

Such relationship between the first area and the second area appropriately secures the differential pressure between the electric-motor chamber 21 and the compression-mechanism chamber 22 so as to appropriately keep the liquid-level difference, i.e., difference in oil level OS of the lubricating oil O between the electric-motor chamber 21 and the compression-mechanism chamber 22, and thereby prevents an excessive liquid-level difference (i.e., prevents a case where the liquid level of the compression-mechanism chamber 22 becomes too high or the liquid level of the electric-motor chamber 21 becomes too low).

The frame 23, 23A, and 23B may be integrated with the main bearing 16. In this case, the step portion 53 is not required on the end face 31*a* of the cylinder 31 and the division between the frame contact-surface 52 and the bearing contact-surface 51 is eliminated.

The rotary compressor 2 and the refrigeration cycle apparatus 1 according to the present embodiments include: the cylinder 31 having the bearing contact-surface 51 that is closer to the electric motor 12 than the frame contact-surface 52; and the frame 23 having the contact-surface 23*a* that is a continuous flat plane above the bolt 25*a* disposed at the lowermost position. Consequently, the rotary compressor 2 and the refrigeration cycle apparatus 1 can accurately control the differential pressure between the electric-motor chamber 21 and the compression-mechanism chamber 22. In other words, the rotary compressor 2 and the refrigeration cycle apparatus 1 can accurately control the difference in oil level OS of the lubricating oil O between the electric-motor chamber 21 and the compression-mechanism chamber 22. In addition, the surface roughness of the frame contact-surface 52 is rougher than the surface roughness of the bearing contact-surface 51. Consequently, the rotary compressor 2 and the refrigeration cycle apparatus 1 can firmly fasten the cylinder 31 to the frame 23, which reliably reduces the displacement of the contact surface between the cylinder 31 and the frame 23 due to, for example, an external load to be applied in a transportation process.

Additionally, the rotary compressor 2 and the refrigeration cycle apparatus 1 according to the present embodiments have the gap 72 between the cylinder 31 and the frame 23. The gap 72 is located near the suction passage 48 and penetrates the frame 23 in the radial direction. Consequently, the rotary compressor 2 and the refrigeration cycle apparatus 1 can prevent the influence of the deformation of the cylinder 31 due to laying of the suction passage 48 from affecting the contact surface between the cylinder 31 and the frame 23, and thus can reliably separate the electric-motor chamber 21 from the compression-mechanism chamber 22 so as to accurately control the difference in oil level OS of lubricating oil O between the electric-motor chamber 21 and the compression-mechanism chamber 22.

Further, the rotary compressor 2 and the refrigeration cycle apparatus 1 according to the present embodiments include the convex portion 71 that protrudes into a C-shape interrupted by the gap 72 and has the contact-surface 23*a* being in contact with the frame contact-surface 52 of the cylinder 31. Consequently, the rotary compressor 2 and the refrigeration cycle apparatus 1 can readily form the gap 72 on the contact surface between the cylinder 31 and the frame 23.

Moreover, the rotary compressor 2 and the refrigeration cycle apparatus 1 according to the present embodiments include the gap 72 filled with the lubricating oil O in the sealed housing 11. Consequently, the rotary compressor 2 and the refrigeration cycle apparatus 1 prevent the suction passage 48 near the gap 72 from being heated by the compressed refrigerant, and improve the performance by preventing the refrigerant to be sucked into the cylinder chamber 29 from being heated.

In the rotary compressor 2 and the refrigeration cycle apparatus 1 according to the present embodiments, when the sum of the cross-sectional areas of the compressed-refrigerant passages 45 is defined as the first area and the sum of the cross-sectional areas of the suction passage 48 is defined as the second area, the relationship between the first area and the second area is set to satisfy the following expression.

$$0.5<(\text{first area}/\text{second area})<0.85$$

Consequently, it is suitable when carbon dioxide is used as the refrigerant.

Furthermore, in the rotary compressor 2 and the refrigeration cycle apparatus 1 according to the present embodiments, the phase difference θ between the compressed-refrigerant passage 45 and the discharge passage 49 is set to 10 degrees or more. Consequently, the rotary compressor 2 and the refrigeration cycle apparatus 1 can prevent the lubricating oil O in the compression-mechanism chamber 22 from being raised by the compressed refrigerant, which flows from the compressed-refrigerant passage 45 to the discharge passage 49, and from flowing out of the rotary compressor 2 (so called oil discharge).

In addition, the rotary compressor 2 and the refrigeration cycle apparatus 1 according to the present embodiments include the compressed-refrigerant passage 45A that is inclined toward the oil level OS of the lubricating oil O in the compression-mechanism chamber 22. Consequently, the rotary compressor 2 and the refrigeration cycle apparatus 1 can prevent the lubricating oil O in the compression-mechanism chamber 22 from being raised by the compressed refrigerant, which flows from the compressed-refrigerant passage 45A to the discharge passage 49, and from flowing out of the rotary compressor 2.

Further, the rotary compressor 2 and the refrigeration cycle apparatus 1 according to the present embodiments include the differential pressure regulating valve 81 that is provided in at least one of the compressed-refrigerant passages 45B and is opened when the differential pressure between the electric-motor chamber 21 and the compression-mechanism chamber 22 reaches the predetermined differential pressure. Consequently, the rotary compressor 2 and the refrigeration cycle apparatus 1 can readily and accurately control the difference in oil level OS of the lubricating oil O between the electric-motor chamber 21 and the compression-mechanism chamber 22.

According to the rotary compressor 2 of the present embodiments and the refrigeration cycle apparatus 1 provided with this rotary compressor 2, the compression mechanism 13 can be supported in the sealed housing 11 via the frame 23, the lubricating oil supply to the compression mechanism 13 can be reliably continued, energy loss of the electric motor 12 can be prevented, and the rotary compressor 2 and the refrigeration cycle apparatus 1 obtain high reliability.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

REFERENCE SIGNS LIST

1 refrigeration cycle apparatus
2 rotary compressor
3 radiator
5 expansion device
6 heat absorber
7 accumulator
8 refrigerant pipe
11 sealed housing
11*a* body portion
11*b* end plate
12 electric motor
13 compression mechanism
15 rotating shaft
15*a* one end
15*b* intermediate portion
15*c* other end
16 main bearing
16*a* contact surface
17 auxiliary bearing
21 electric-motor chamber
22 compression-mechanism chamber
23, 23A, 23B frame
23*a* cylinder contact-surface
25, 25*a* bolt
26 stator
27 rotor
28 eccentric portion
29 cylinder chamber
31 cylinder
31*a* end face
31*b* end face
32 roller
35 bolt
37 discharge-valve mechanism
38 discharge muffler
41 bolt
45, 45A, 45B compressed-refrigerant passage
46 lubricating-oil passage
48 suction passage
49 discharge passage
51 bearing contact-surface
52 frame contact-surface
53 step portion
61 vane groove
62 vane back chamber
64 screw hole
65 through hole
66 lubricating-oil passage
71 convex portion
72 gap
73, 73*a* screw hole
81 differential pressure regulating valve

The invention claimed is:

1. A rotary compressor comprising:
a horizontal housing that stores lubricating oil;
an electric motor that is housed in the housing;
a compression mechanism that is housed in the housing;
a rotating shaft that extends in a longitudinal direction of the housing and connects the electric motor to the compression mechanism;
a frame that supports the compression mechanism in the housing, divides inside of the housing into an electric-motor chamber for housing the electric motor and a compression-mechanism chamber for housing the compression mechanism, and includes at least one compressed-refrigerant passage for leading compressed refrigerant from the electric-motor chamber to the compression-mechanism chamber and a lubricating-oil passage for flowing lubricating oil between the electric-motor chamber and the compression-mechanism chamber; and
a plurality of fasteners that fasten the compression mechanism to the frame,
wherein the compression mechanism includes a cylinder provided with a cylinder chamber, and a main bearing that is fixed to a face of the cylinder on a side closer to the electric motor to seal the cylinder chamber and rotatably supports the rotating shaft,
wherein a face of the cylinder on a side close to the electric motor is fixed to a cylinder contact-surface of the frame,
wherein the face of the cylinder on the side close to the electric motor includes a bearing contact-surface in contact with the main bearing, and a frame contact-surface that is disposed radially outside of the cylinder than the bearing contact-surface to contact the frame,
wherein the bearing contact-surface is closer to the electric motor than the frame contact-surface,
wherein surface roughness of the frame contact-surface is rougher than surface roughness of the bearing contact-surface, and
wherein the cylinder contact-surface in contact with the frame contact-surface is a continuous flat plane above a fastener disposed at a lowermost position among the plurality of fasteners.

2. The rotary compressor according to claim 1, further comprising a suction passage that penetrates the housing and the cylinder, is connected to the cylinder chamber, and leads working fluid from outside of the housing to the cylinder chamber,
wherein a gap is formed between the frame and the cylinder near the suction passage.

3. The rotary compressor according to claim 2, wherein the cylinder contact-surface of the frame is a convex portion protruding in a C-shape.

4. The rotary compressor according to claim 3, wherein the gap is filled with the lubricating oil in the housing.

5. The rotary compressor according to claim 4, wherein the working fluid is carbon dioxide, and
wherein, when sum of cross-sectional areas of the at least one compressed-refrigerant passage is defined as a first area, and sum of passage cross-sectional areas of the suction passage is defined as a second area, relationship between the first area and the second area satisfies $0.5<\text{first area}/\text{second area}<0.85$.

6. The rotary compressor according to claim 3, wherein the working fluid is carbon dioxide, and
wherein, when sum of cross-sectional areas of the at least one compressed-refrigerant passage is defined as a first area, and sum of passage cross-sectional areas of the suction passage is defined as a second area, relationship between the first area and the second area satisfies 0.5<first area/second area<0.85.

7. The rotary compressor according to claim 3, further comprising a discharge passage that is provided to penetrate the housing and, discharges the compressed refrigerant from inside of the housing, wherein:

an angle formed by the compressed-refrigerant passage and the discharge passage with reference to a centerline of the housing is 10 degrees or more; and the compressed-refrigerant passage is inclined toward an oil surface direction of the lubricating oil in the compression-mechanism chamber.

8. The rotary compressor according to claim 2, wherein the gap is filled with the lubricating oil in the housing.

9. The rotary compressor according to claim 8, wherein the working fluid is carbon dioxide, and wherein, when sum of cross-sectional areas of the at least one compressed-refrigerant passage is defined as a first area, and sum of passage cross-sectional areas of the suction passage is defined as a second area, relationship between the first area and the second area satisfies 0.5<first area/second area<0.85.

10. The rotary compressor according to claim 8, further comprising a discharge passage that is provided to penetrate the housing and, discharges the compressed refrigerant from inside of the housing, wherein:

an angle formed by the compressed-refrigerant passage and the discharge passage with reference to a centerline of the housing is 10 degrees or more; and the compressed-refrigerant passage is inclined toward an oil surface direction of the lubricating oil in the compression-mechanism chamber.

11. The rotary compressor according to claim 2, wherein the working fluid is carbon dioxide, and wherein, when sum of cross-sectional areas of the at least one compressed-refrigerant passage is defined as a first area, and sum of passage cross-sectional areas of the suction passage is defined as a second area, relationship between the first area and the second area satisfies 0.5<first area/second area<0.85.

12. The rotary compressor according to claim 11, further comprising a discharge passage that is provided to penetrate the housing and, discharges the compressed refrigerant from inside of the housing, wherein:

an angle formed by the compressed-refrigerant passage and the discharge passage with reference to a centerline of the housing is 10 degrees or more; and the compressed-refrigerant passage is inclined toward an oil surface direction of the lubricating oil in the compression-mechanism chamber.

13. A refrigeration cycle apparatus comprising:

the rotary compressor according to claim 11;

a radiator;

an expansion device;

a heat absorber; and a refrigerant pipe that connects the rotary compressor, the radiator, the expansion device, and the heat absorber to circulate a refrigerant.

14. The rotary compressor according to claim 2, further comprising a discharge passage that is provided to penetrate the housing and, discharges the compressed refrigerant from inside of the housing, wherein:

an angle formed by the compressed-refrigerant passage and the discharge passage with reference to a centerline of the housing is 10 degrees or more; and the compressed-refrigerant passage is inclined toward an oil surface direction of the lubricating oil in the compression-mechanism chamber.

15. The rotary compressor according to claim 1, further comprising a discharge passage that is provided to penetrate the housing and, discharges the compressed refrigerant from inside of the housing, wherein:

an angle formed by the compressed-refrigerant passage and the discharge passage with reference to a centerline of the housing is 10 degrees or more; and the compressed-refrigerant passage is inclined toward an oil surface direction of the lubricating oil in the compression-mechanism chamber.

16. The rotary compressor according to claim 1, further comprising a differential pressure regulating valve that is provided in the at least one compressed refrigerant passage, and is opened when a differential pressure between the electric-motor chamber and the compression-mechanism chamber reaches a predetermined differential pressure.

17. A refrigeration cycle apparatus comprising:

the rotary compressor according to claim 1;

a radiator;

an expansion device;

a heat sink; and a refrigerant pipe that connects the rotary compressor, the radiator, the expansion device, and the heat absorber to circulate a refrigerant.

* * * * *